United States Patent [19]

Kaplan

[11] 4,391,039

[45] Jul. 5, 1983

[54] ELECTRIC WIRE TERMINAL CONNECTING METHOD

[75] Inventor: Jonathan I. Kaplan, West Newton, Mass.

[73] Assignee: Polaroid Corporation, Cambridge, Mass.

[21] Appl. No.: 287,766

[22] Filed: Jul. 22, 1981

Related U.S. Application Data

[62] Division of Ser. No. 67,029, Aug. 16, 1979, Pat. No. 4,281,886.

[51] Int. Cl.[3] ..... H01R 43/00

[52] U.S. Cl. ..... 29/884; 29/857

[58] Field of Search ..... 29/407, 593, 857, 884; 339/97 L, 99, 103 R, 150 B, 151 B, 147 P, 149 P; 174/138 F; 324/51

[56] References Cited

U.S. PATENT DOCUMENTS

| | | | |
|---|---|---|---|
| 3,601,779 | 8/1971 | Waller, Sr. | 339/103 M X |
| 3,617,876 | 11/1971 | Robinson | 29/593 X |
| 3,824,527 | 7/1974 | Evans | 339/97 R |
| 3,836,944 | 9/1974 | Lawson | 339/99 R |
| 3,910,672 | 10/1975 | Frantz | 339/97 P |
| 3,979,615 | 9/1976 | Neff | 310/71 |
| 3,979,762 | 9/1976 | Hendry et al. | 354/288 |
| 4,045,112 | 8/1977 | Rodondi et al. | 339/99 R |
| 4,053,705 | 10/1977 | Schmidt | 174/138 F |
| 4,118,103 | 10/1978 | Leidy et al. | 339/98 |
| 4,130,331 | 12/1978 | Neff et al. | 339/97 R |
| 4,147,398 | 4/1979 | Lill | 339/98 |
| 4,178,057 | 12/1979 | McCormick | 339/103 M |
| 4,195,898 | 4/1980 | Chow et al. | 339/103 R X |

*Primary Examiner*—Francis S. Husar
*Assistant Examiner*—Carl J. Arbes
*Attorney, Agent, or Firm*—Edward S. Roman

[57] ABSTRACT

A wire terminal connection by which a leaf-like contact may be electrically joined with a stripped end portion of a wire lead retained by a non-conductive mounting structure for the contact. As disclosed, the connection is embodied in a battery contact assembly of a photographic camera in which all electrical components are assembled as an interior module to be pretested for operational reliability prior to assembly of the module with an exterior housing. The retention of the wire leads by the non-conductive contact mounting facilitates module assembly and pretesting prior to applying the battery contacts.

1 Claim, 11 Drawing Figures

FIG. 3.
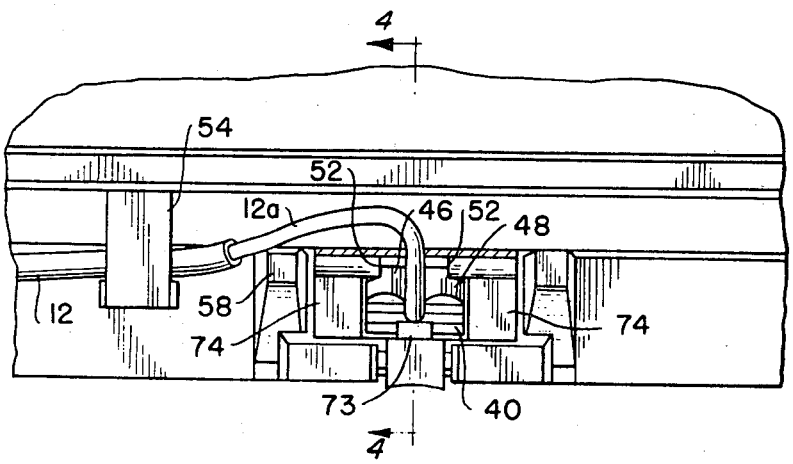
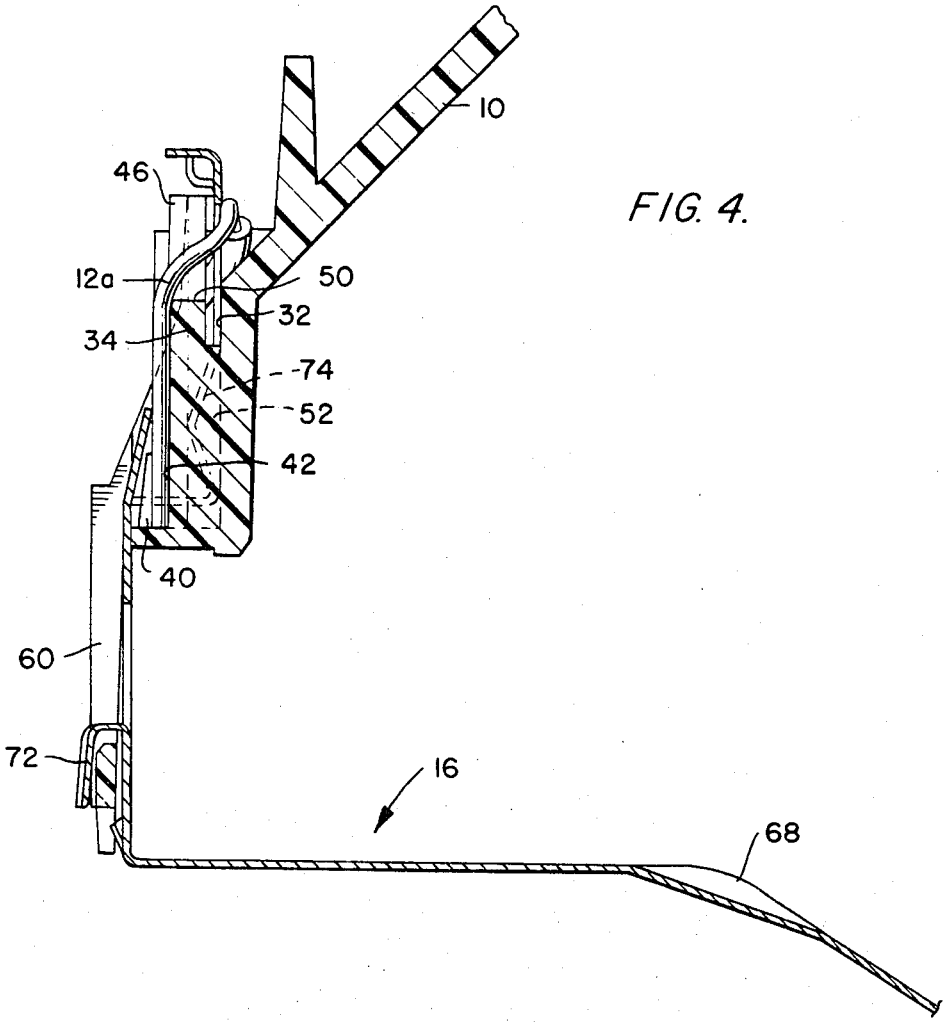
FIG. 4.

FIG. 6.
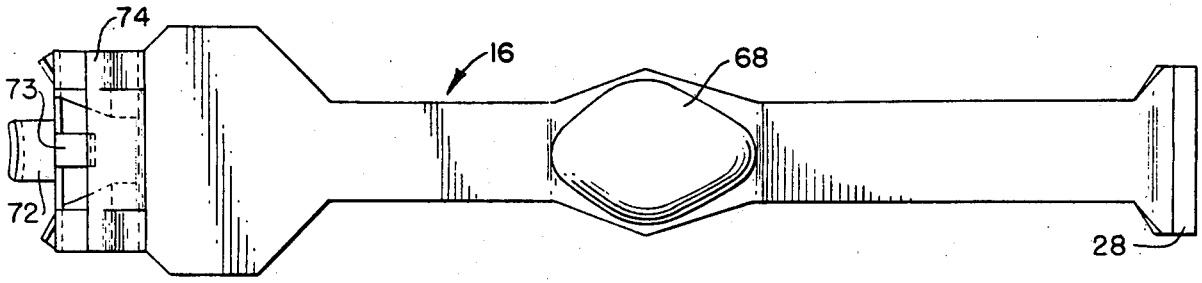
FIG. 8.
FIG. 7.
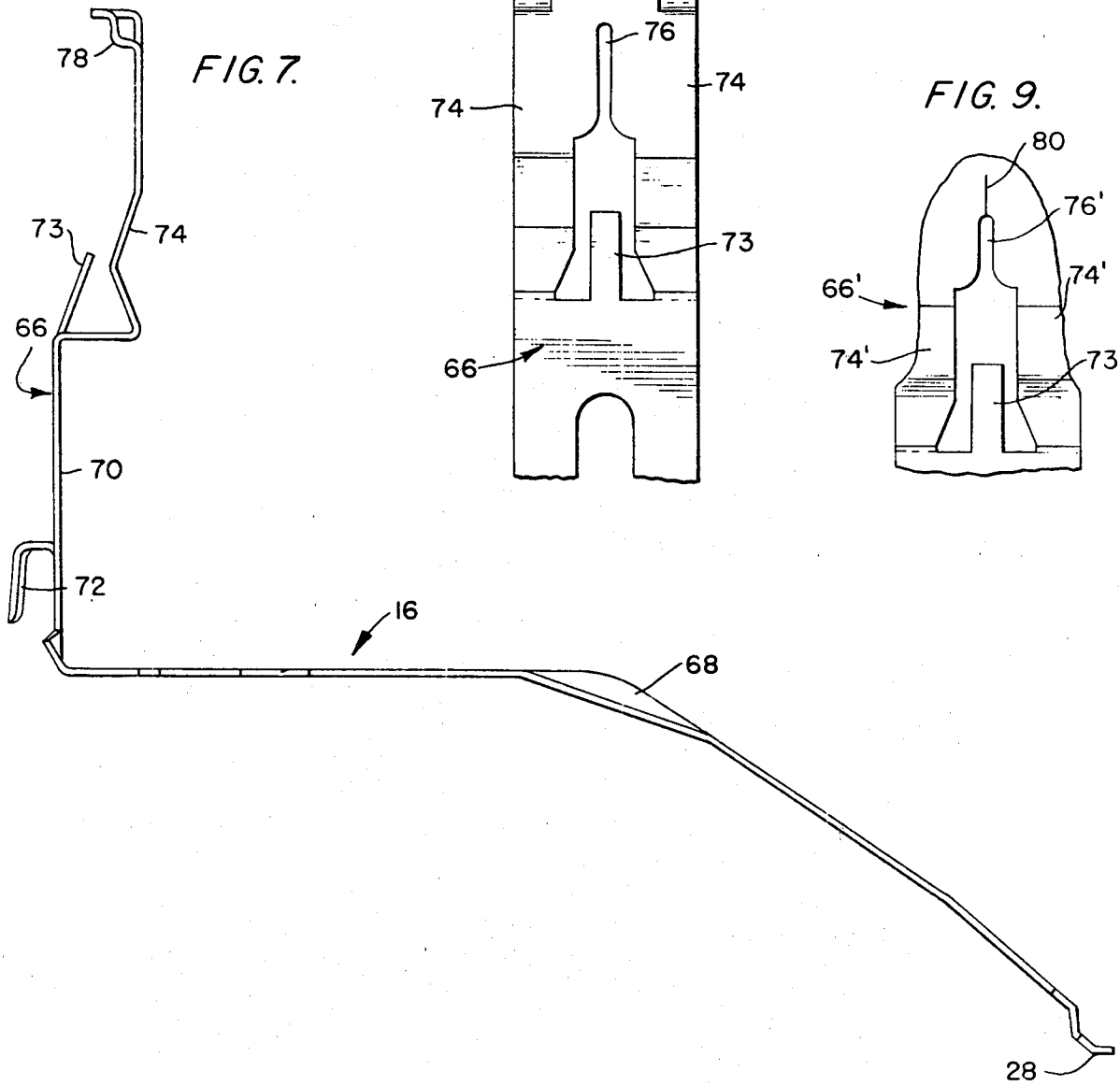
FIG. 9.

ELECTRIC WIRE TERMINAL CONNECTING METHOD

This is a division of application Ser. No. 067,029, filed Aug. 16, 1979 and now U.S. Pat. No. 4,281,886 issued July 31, 1981.

BACKGROUND OF THE INVENTION

This invention relates to electric wire terminal connections and more particularly, it concerns the assembly and electrical connection of a terminal contact with one or more wires of an electrical system having particular but not exclusive application in pretestable modules used in the manufacture of photographic cameras.

In U.S. Pat. No. 3,979,762, issued Sept. 7, 1976, to Donald H. Hendry, et al., there is disclosed a modular photographic system in which substantially all functioning camera components needed for exposure and processing of instant photographic film units are preassembled as a module with an interior structural member during manufacture so that prior to assembly of the module and a protective exterior camera housing, the several functioning components of the module may be tested for operational reliability. Primary support for the module is provided by a generally pyramid-shaped enclosure which is open at its bottom to define a rectangular window corresponding in size and configuration to the image format on the film to be exposed in the camera.

Electrical components in the photographic system disclosed in the aforementioned patent are designed to be powered by a sheet-like battery supplied with each pack of film units to be exposed and processed in the camera. Specifically, the battery terminals are presented in a pair of openings in the bottom wall of a box-like container forming part of each film pack. The film pack is insertable into a film pack chamber defined in part by the exterior housing of the camera and in part by the open bottom support structure of the interior module. When fully in place, the battery terminals are engaged by a pair of resilient leaf-like contacts extending from a lower back surface of the interior module support structure where they are connected with wire leads extending to the electrically operated components.

Although the battery contacts referred to are physically connected to the interior module support structure, the leaf-like battery terminal engaging portions thereof extend forwardly under the module support structure and are physically supported in part by the exterior casing structure in the completed camera. Prior to assembly with the exterior housing, however, the battery contacts extend from the lower back portion of the module support forwardly, in unsupported cantilever fashion, through a substantial distance under the bottom opening in the interior module support.

In the past, the connection of the cantilevered battery contacts to wire leads was effected by a soldered joint. As a result, the wire leads and the battery contacts were necessarily connected to each other and to the module support structure early in the manufacturing or assembly process. This factor, coupled with the relatively long unsupported length of the leaf-like battery contact under the module support and subsequent handling of the module support during completion and testing of the module has resulted in considerable damage to the relatively fragile, leaf-like battery contacts prior to assembly of the module with the outer protective casing.

The modular photographic system disclosed in the aforementioned patent has been demonstrated as highly cost-effective in the mass production of sophisticated photographic cameras. The problems associated with a requirement for a soldered connection of the battery contacts to wire leads and damage to the contacts by handling during manufacture and prior to assembly with the exterior housing, however, leave room for improvement and further reduction in manufacturing costs.

SUMMARY OF THE INVENTION

In accordance with the present invention, an improved solderless wire terminal connection is provided by which manufacturing costs incident to the assembly of pretestable modules are reduced with improved quality of the terminal connection and of the product so manufactured. The connection is effected by a combined wire lead mount, capable of temporarily supporting a stripped end portion of a wire lead in a pre-established orientation for contact with a pretesting electric circuit, and a contact structure capable of direct placement on the lead mount in a manner to insure both mechanical integrity and electric circuit continuity between the contact structure and the wire lead.

In the organization of the camera module mentioned above, the wire lead mount is defined by a lead end anchorage and a bracket formation integral with the molded module support structure. This formation facilitates a manual application of a wire lead to the module and positions the stripped end portion of the wire in a readily accessible position for contact by testing probes or the like. In addition, the stripped end portion of the wire lead is retained in a configuration capable of being easily and positively engaged by a slotted or bifurcated portion of the battery contact when the latter is mounted on the module support.

Among the objects of the present invention are, therefore, the provision of an improved electric wire terminal connection; the provision of such a connection which facilitates placement of a wire lead for engagement by a subsequently applied terminal contact; the provision of such a connection in which a wire lead may be easily and firmly positioned in a pre-established orientation on an insulative support structure to be accessible for contact by electric test probes and the like; the provision of such a connection which is particularly applicable to the manufacture and assembly of pretestable functioning modules; and the provision of a method of manufacture by functioning modular assembly in which preassembled modules are pretested prior to final assembly in an electrically powered apparatus such as a photographic camera without risk of damage to the terminal contacts.

Other objects and further scope of applicability of the present invention will become apparent from the detailed description to follow taken in conjunction with the accompanying drawings in which like parts are designated by like reference numerals.

BRIEF DESCRIPTION OF THE DRAWINGS

FIG. 3 is a partial cross-section on line 3—3 of FIG. 2;

FIG. 4 is a fragmentary cross-section taken on line 4—4 of FIG. 3;

FIG. 6 is a plan view of the battery contact and terminal connection shown in FIGS. 5*a*–5*c*;

FIG. 7 is a side elevation of the contact shown in FIG. 6;

FIG. 8 is a fragmentary rear elevation of the battery contact shown in FIGS. 6 and 7; and FIG. 9 is a fragmentary rear elevation of an alternative embodiment of the battery contact illustrated in FIGS. 6–8.

DESCRIPTION OF THE PRIOR ART

Figure 1:
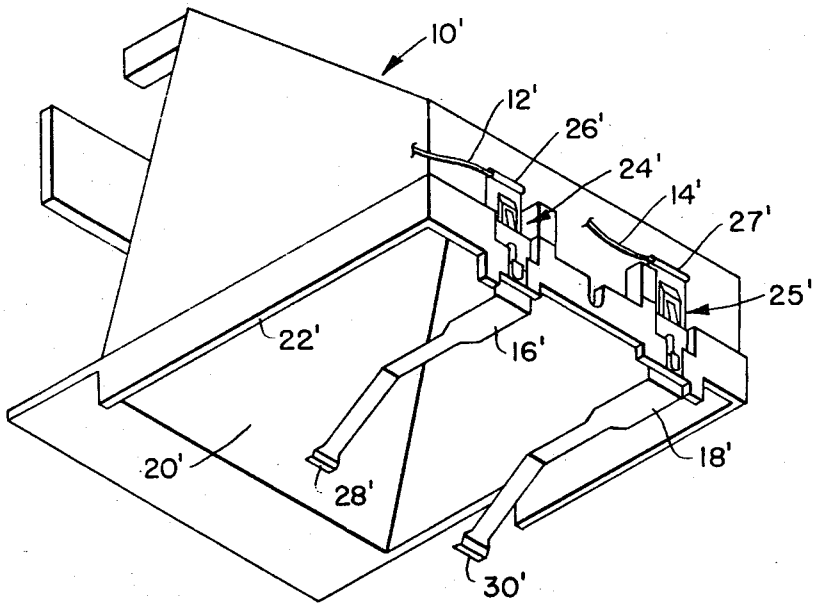
FIG. 1. (PRIOR ART)
FIG. 1 is a bottom perspective view of a module support structure for photographic cameras in which battery contacts have been mounted and connected in accordance with the prior art.

In FIG. 1 of the drawings, the primary module support structure for a photographic camera constructed in accordance with the disclosure of U.S. Pat. No. 3,979,762 is shown to comprise a hollow pyramid-like member 10′ molded of synthetic resinous material or other suitable material which is electrically nonconductive. Though not illustrated in FIG. 1, it will be readily apparent by reference to the aforementioned U.S. patent that the member 10′ is designed to support substantially all functioning assemblies or sub-modules of a photographic camera in which it is designed for use. These functioning components include an electronic shutter sub-module, a gear train and motor sub-module, a view finder sub-module, a flash socket bonnet and a door housing containing a motor driven pinch roll pair. All of these components which are not shown in FIG. 1 are designed, in accordance with the prior art, so as to be operational when connected with a source of electric current. To this end, the operating sub-modules or components are connected by wire leads 12′ and 14′ to a pair of battery contacts 16′ and 18′, respectively. It will be noted further from FIG. 1, that the pyramid-like structure 10′ defines an interior exposure chamber 20′ which opens in a generally rectangular frame 22′. In practice, the frame defines the area of a film unit (not shown) on which an image is formed photographically by the camera in which the member 10′ is used.

Also as shown in FIG. 1, the battery contacts 16′ and 18′ are cantilevered forwardly from the lower back portion of the member 10′ and secured to mounting formations 24′ and 25′ molded integrally in the member 10′. In the past, the battery contacts were joined electrically with the wire leads 12′ and 14′ by solder joints 26′ and 27′ during the assembly of the contacts 16′ and 18′ and the member 10′. This was done early in the manufacturing procedure and at least prior to pretesting of the sub-modules referred to so that the mounting portions of the battery contacts 16′ and 18′ could be engaged by testing probes in circuit with an appropriate electric power source.

It will also be noted that the cantilevered portions of the battery contacts 16′ and 18′ project freely under the exposure chamber 20′. Though supported at their ends 28′ and 30′ in the finished camera, they remain unsupported on the module support structure or the member 10′ during pretesting and during handling over a substantial portion of the module assembly prior to incorporation in the final exterior housing (not shown). As a result, the ends 28′ and 30′ of the contacts 16′ and 18′ are easily bent or twisted during handling to a point where they are defective in the final product.

Because many of the mentioned components or sub-modules supported by the member 10′ are not shown in the drawings, the disclosure of U.S. Pat. No. 3,979,762 is incorporated herein by reference to the extent it is needed for a full appreciation of the prior art and the improvements of the present invention relative to such prior art.

DETAILED DESCRIPTION OF THE PREFERRED EMBODIMENTS

In FIGS. 2–9 of the drawings, components of the present invention which correspond in function to components of the prior art identified in FIG. 1 are designated by the same reference numerals which are not primed. In FIGS. 2–5, therefore, the lower back portion of the pyramid-shaped support member 10 is shown to include a battery contact mounting formation 24 from which a wire lead 12 and a battery contact 16 are supported and electrically connected in a manner to be described. Although two such assemblies will be employed in practice in accordance with prior art and as shown in FIG. 1, only one is illustrated in the drawings because they are identical.

In FIGS. 2–5, the contact mounting formation integrally molded in the lower back portion of the support member 10 may be seen to include a generally planar wall surface 32 from which projects a vertically oriented bracket formation 34. The bracket formation 34 is shaped to provide a front face 36 extending between head portion 38 and a downwardly and forwardly inclined foot portion 40. As may be seen most clearly in FIGS. 4 and 5, the foot portion 40 defines a wire end receiving pocket 42 generally coextensive with the front face 36 and in particular with a semicircular groove 44 (FIG. 5*a*) extending the length of the front face 36. The head portion 38 of the bracket formation 34 is of a configuration to establish a relatively tall vertically projecting post 46, the front face of which is coextensive with the front face 36 of the bracket formation, while the rear face of the post 46 is spaced forwardly from the plane of the wall surface 32 (see FIG. 4). A relatively short post extension 48 at the head portion 38 of the bracket formation 34 provides a wire cradle 50 at the top of the bracket formation 34. Also, as is shown most clearly in FIG. 3, the bracket formation 34 and the wall surface 32 define a pair of oppositely opening longitudinal channels 52. (FIG. 3).

Figure 2:
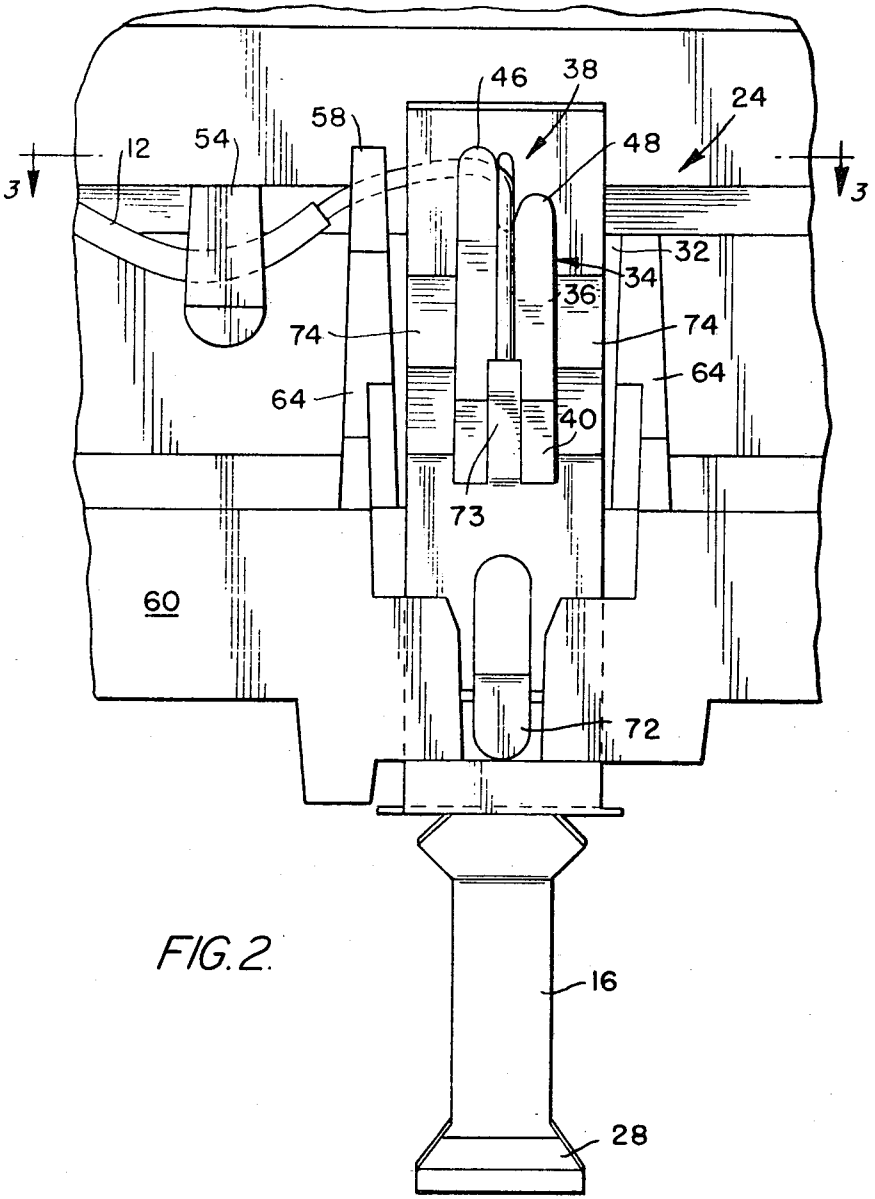
FIG. 2 is a fragmentary rear elevation illustrating the completed electric wire terminal connection of the present invention.
Figure 5A:
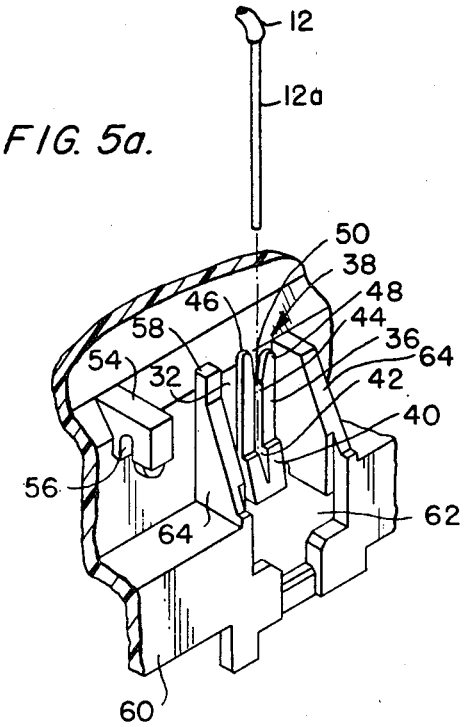
FIGS. 5*a*–5*c* are exploded fragmentary perspective views illustrating successive steps in the assembly of the battery contact and terminal connection of the present invention.

Spaced from the bracket formation 34 and projecting integrally from the member 10 is a wire anchorage 54 (FIGS. 2, 3 and 5). As shown most clearly in FIG. 5*a*, the anchorage 54 includes a downwardly opening groove or slot 56 dimensioned to receive snuggly an insulated intermediate portion of the wire lead 12. Situated between the anchorage 54 and the bracket formation 34 is a guide post 58, the rear surface of which is essentially coplanar with the wall surface 32 (FIG. 3).

As in prior art embodiments of the member 10, a bottom skirt portion 60 is displaced laterally of the wall surface 32 to define an opening 62 circumscribed by the wall surface 32, the skirt 60 and by a pair of gusset formations 64 spaced on opposite sides of the bracket formation 34. The opening 62 facilitates placement of the battery contact 16 by insertion of the end 28 through the opening 62 as depicted by FIG. 5*c*.

As illustrated most clearly in FIGS. 5*c*, 6, 8 and 9 of the drawings, a preferred embodiment of the battery contact 16 is shown. The battery contact is conventional or like that illustrated in FIG. 1 to the extent that it is constituted by a metallic leaf-like structure of generally L-shaped configuration to establish a horizontal leg terminating in the end 28 and a vertically oriented mounting leg or portion 66. The horizontal leg is conventional and as such, includes a battery terminal contact embossment 68 centrally of its length.

The mounting leg or portion 66 of the contact 16 is similarly conventional or like the prior art to the extent that it includes a planar portion 70 having a struck out tab 72 to engage a notched portion of the skirt 60 and a pair of inwardly displaced and bent legs 74 to be received under a resilient or yieldable bias in the oppositely opening channels 52 between the bracket formation 34 and the wall surface 32. Also, an inwardly inclined upstanding tab 73 is provided to engage the front face 36 and the stripped end portion 12*a* of the wire lead 12. The mounting portion, however, differs from the prior art in that it is shaped to define a vertical contact slot 76 at the upper or base end of the leg 74.

Figure 5B:
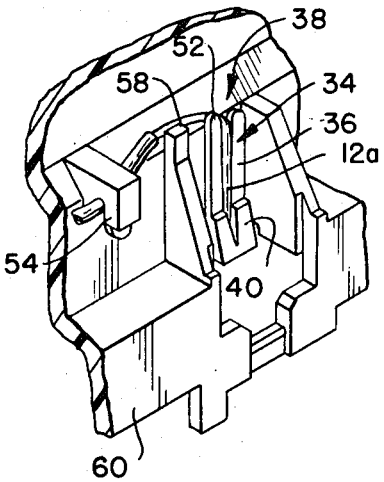
Figure 5C:
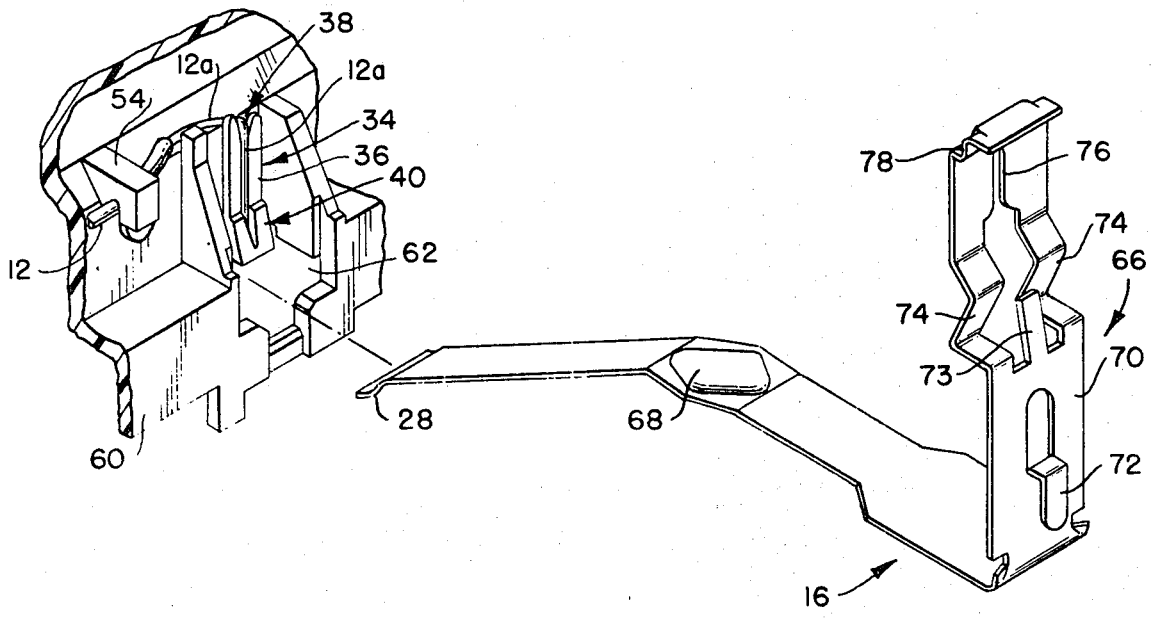

The assembly of the wire lead 12 and the battery contact 16 to the mounting portion 24 is depicted by the drawing sequence of FIGS. 5*a*–5*c*. Thus, as shown in FIG. 5*a*, a stripped end portion 12*a* of the wire lead 12 is inserted downwardly into the pocket 42 so that a straight run of the end portion 12*a* will lie in the semicircular groove 44 along the front face 36 of the bracket formation 34. In this respect, it is to be noted that the depth of the groove 44 is less than the diameter of the stripped end portion 12*a* of the wire 12 so that the run of wire in the groove will be exposed. As depicted in FIG. 5*b*, the lead 12 is then bent rearwardly through the cradle 50, about the post extension 46, the guide post 58 and into the slot 56 of the anchorage 54.

As a result of the configuration of the mounting formation 24 and the manner in which the wire lead 12 is inserted and manipulated to the anchorage 54, the conductive end portion 12*a* of the lead will be physically retained in the anchorage such that the stripped end portion 12*a* lying on the front face 36 of the bracket formation 34 will be accessible to probes of a test circuit. In the assembly of the interior camera module disclosed in the aforementioned U.S. Pat. No. 3,979,762, all electrical components may be assembled on the member 10 and connected with the lead 12. During this assembly of sub-modules, the battery contact 16 and its duplicate (not shown) are left unassembled with the member 10. After pretesting of electrical components supported by the member 10 and just prior to assembly of the completed interior module with an exterior camera housing (not shown), the terminal 16 is mounted by inserting the end 28 thereof through the aperture 62 such that the base portion of the legs 74 lie above the head portion 38 of the bracket formation 34. The mounting leg or portion 66 of the terminal is then depressed downwardly so that the legs slide in the oppositely facing channels 52 and ultimately so that the portion of the bent end portion 12*a* of the wire lead extending between the cradle 50 and the plane of the wall 32 is received in the slot 76. The slot 76 is of a width with respect to the stripped end portion 12*a* of the wire lead such that a binding or pressure contact is established between the lead portion 12*a* and the contact 16.

In addition to the electrical contact between the stripped wire lead portion 12*a* and the slot 76, electrical contact is augmented through engagement of the run of the wire lead portion in the groove 44 by the tab 73. Further, and as shown most clearly in FIGS. 5*c*, 7 and 8 of the drawings, the top of the mounting portion 66 is struck out on opposite sides to provide an alternative receptacle for either an auxiliary wire lead (not shown) or as an alternate point of connection for the lead 12 as may be required to facilitate repair of the connection between the lead 12 and the terminal 16.

In the embodiment of FIGS. 6–8, the length of the slot 76 is longer than is necessary to accommodate downward movement of the mounting portion 66 in the assembly of the contact 16 with the member 10. This increased length allows for the legs 74 to be displaced out of the generally planar orientation thereof in the region of the slot without damage to the contact during assembly. In FIG. 9, an alternative embodiment is shown in which the length of the slot 76' is shortened so that when the contact having the slot 76' is mounted, the stripped wire lead portion 12*a* will be received at the upper end of the slot. To allow deflection of the legs 74' out of their initially planar orientation, the top of the slot 76' is provided with a lance 80. In all other respects, the embodiment of FIG. 9 is the same as that previously described.

Thus it will be seen that as a result of the present invention, a highly improved teminal connection is provided by which the above-mentioned objectives are completely fulfilled. Also it will be apparent to those skilled in the art from the preceding description that modifications and/or changes may be made in the illustrated embodiments without departure from the invention. Accordingly, it is expressly intended that the foregoing is illustrative of preferred embodiments only, not limiting, and that the true spirit and scope of the present invention will be determined by reference to the appended claims.

What is claimed is:

1. The method of assembling a photographic camera having an internal support member on which functioning electrical components are mounted to provide a functioning module for subsequent completion and assembly in an exterior housing, said method comprising the steps of:

assembling wire leads on said module for connection of components with a source of electrical energy;

fixing a conductive end portion of said wire leads to a non-conductive bracket formation;

pretesting said module by connecting a source of electrical test energy with said retained conductive end portions of said wire leads; and assembling leaf-like battery contacts on said support member to be electrically joined with said wire lead conductive end portions after said pretesting step.

* * * * *